US010016774B2

(12) United States Patent
Ribeiro

(10) Patent No.: US 10,016,774 B2
(45) Date of Patent: Jul. 10, 2018

(54) PAINTING PLANT

(75) Inventor: Carlos Ribeiro, Saigon (VN)

(73) Assignee: OERLIKON SURFACE SOLUTIONS AG, PFÄFFIKON, Pfäffikon SZ (CH)

( * ) Notice: Subject to any disclaimer, the term of this patent is extended or adjusted under 35 U.S.C. 154(b) by 249 days.

(21) Appl. No.: 14/124,427

(22) PCT Filed: May 31, 2012

(86) PCT No.: PCT/EP2012/002304

§ 371 (c)(1),
(2), (4) Date: Jan. 22, 2014

(87) PCT Pub. No.: WO2012/167885

PCT Pub. Date: Dec. 13, 2012

(65) Prior Publication Data

US 2014/0123894 A1 May 8, 2014

(30) Foreign Application Priority Data

Jun. 7, 2011 (DE) ..... 10 2011 106 196

(51) Int. Cl.

| | |
|---|---|
| ***B05B 15/12*** | (2006.01) |
| ***B05B 13/02*** | (2006.01) |
| ***B05B 16/20*** | (2018.01) |
| ***B05B 16/00*** | (2018.01) |
| *B05B 16/60* | (2018.01) |

(52) U.S. Cl.

CPC ..... *B05B 13/0221* (2013.01); *B05B 16/20* (2018.02); *B05B 16/95* (2018.02); *B05B 16/60* (2018.02)

(58) Field of Classification Search

CPC ..... B05B 15/1207; B05B 16/20; B05B 16/90; B05B 16/95; B05B 13/0221

See application file for complete search history.

(56) References Cited

U.S. PATENT DOCUMENTS 4,096,300 A * 6/1978 William ..... B05B 15/1207 118/314
6,647,918 B1 * 11/2003 Welch ..... H01J 37/32458 118/715
2005/0266171 A1 * 12/2005 Noguchi ..... B05D 7/02 427/532
2006/0260938 A1 * 11/2006 Petrach ..... C23C 14/568 204/298.16
2009/0277384 A1 * 11/2009 Spangler ..... B65G 43/10 118/676

FOREIGN PATENT DOCUMENTS

DE 10 2006 005 629 A1 8/2007
WO 2007/090538 A1 8/2007
WO 2009/018841 A1 2/2009

OTHER PUBLICATIONS

International Search Report for PCT/EP2012/002304 dated Sep. 19, 2012.

* cited by examiner

*Primary Examiner* — Dah-Wei D. Yuan
*Assistant Examiner* — Stephen A Kitt
(74) *Attorney, Agent, or Firm* — Pearne & Gordon LLP

(57) ABSTRACT

The present invention relates to painting plant, the individual apparatus of which, which are required for different process steps, are accommodated in individual detachable modules, thus considerably simplifying the installation of the painting plant as well as the maintenance and servicing thereof.

13 Claims, 2 Drawing Sheets

Figure 1:
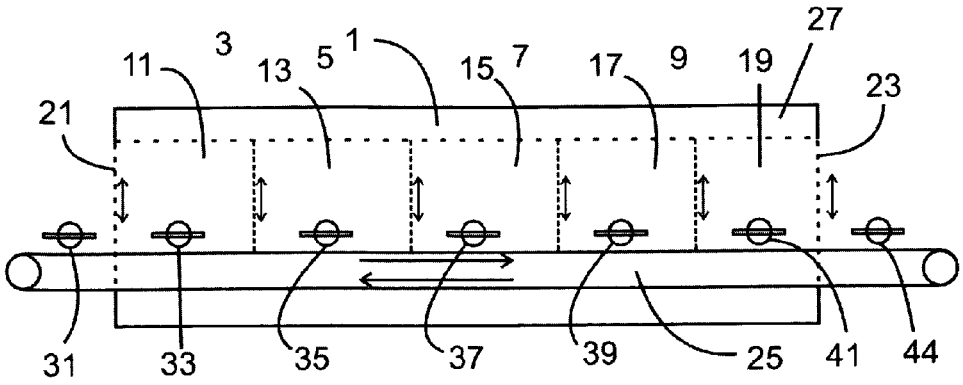
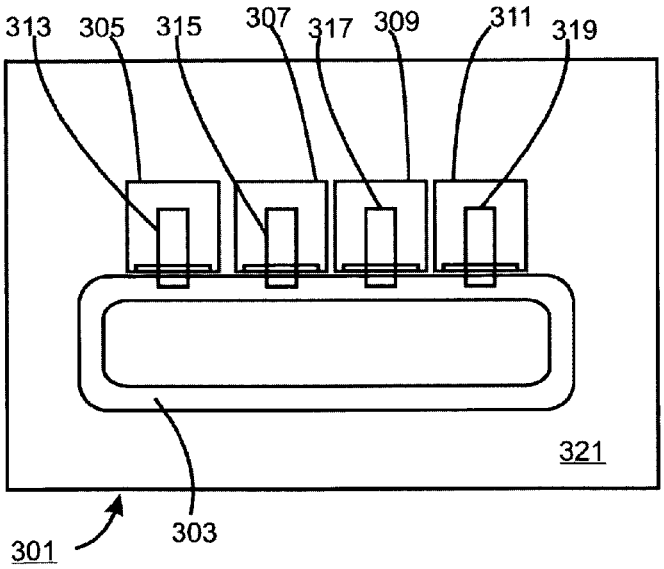
Figure 3:

PAINTING PLANT

The present invention relates to a facility for coating a substrate with at least one organic coating layer. The inventive facility makes it possible in particular to apply a coating layer by means of spraying.

To apply such a coating layer to a substrate, a number of process steps are generally required.

In a first step, the substrate surface is typically cleaned. This can be achieved for example by means of air pressure and/or by means for ionizing the surface resp. by means of irradiating the surface with a liquid medium such as water or an aqueous or alcoholic or solvent-based solution or with a solid, such as shot or C02, or by dipping the substrates in an aqueous or alcoholic or solvent-based solution, possibly under the influence of waves, such as ultrasound waves or microwaves.

In a second step, the actual coating layer is then deposited for example by spraying a coating dispersion. This is followed by a step during which the already coated substrate is baked. This can be achieved by heating in air circulation and/or by exposure to infrared radiation (IR) for example at 50-80° C. In this connection, the solvent usually present in the coating dispersion is essentially evaporated. In case of UV-curable coating material that is very widespread nowadays, i.e. a coating that is cured by ultraviolet light, this curing takes place in one of the step following the solvent evaporation.

Most coatings used are based on organic substances dispersed in solvents. As solvent, aqueous solutions, organic or also inorganic solvent can be considered. The coatings can also be water-based. The curing can be achieved thermally or by radiation curing.

All the above steps can be completed in a single chamber with a substantially stationary substrate. However, in such a multi-function chamber, there is a problem with batch operation in that the equipment that is to be used for cleaning and curing the coating risks being contaminated with coating dispersion or attacked by the evaporated solvent.

For this reason, it is common nowadays to carry out the above steps in different places and in spatially separate sections in the inline operation. FIG. 1 shows a corresponding facility with substrates to be coated 31, 33, 35, 37, 39 and 41. In this case, an elongated chamber 1 is separated into a plurality of sections 11, 13, 15, 17, 19 separated by doors 3, 5, 7, 9, wherein in each section, the apparatus required for executing the step to be performed is provided. At the beginning of the chamber, there is an entrance gate 21 and at the end of the chamber there is an outlet lock 23. A transport device 25 conveys the substrates to be coated into the chamber and to the various stations, as well as out of the chamber. The transport device 25 is usually operated continuously or intermittently, the substrates 31, 33, 35, 37, 39 and 41 being all moved simultaneously. In the case that some substrates are to be processed in one of the separate sections 11, 13, 15, 17 or 19 without moving, while others continue to be transported, those substrates that are to remain motionless are separated by appropriate mechanisms from the transport device 25; the transport device 25 thus becomes substantially more complicated and expensive. This transport device 25 constitutes an integral unit throughout the entire painting facility with a further disadvantage that the divided sections 11, 13, 15, 17 and 19 are insufficiently separated from each other; accordingly, the individual sections 11, 13, 15, 17 and 19 are increased, with the disadvantage that the entire system needs to be made much larger.

Generally, the fresh air supply is provided in the upper portion of each section 11, 13, 15, 17 and 19, and in the bottom area an extraction device is provided that removes air and gases from the chamber portions and feeds them to a cleaning system (not shown). By separating the sections for the different process steps according to the prior art, it is indeed possible to achieve that the different process steps do not adversely affect each other. However, such a coating facility has the disadvantage that it can only be transported with considerable logistical effort because of its size. The assembly and installation of this system thus also involves great effort; it is important in particular to note that for this reason, these systems are not fully constructed at the equipment manufacturer's, which has the major disadvantage that the complete and final fine-tuning of all system functions and the corresponding process steps can only be carried out at on the customer's premises.

A further embodiment of a coating installation 301, see FIG. 3, according to the prior art and which attempts to overcome some of the disadvantages mentioned above will be explained as follows:

The essentially inseparable portions of the cleaning operation, paint application and curing are not arranged inline, but immediately adjacent to the transport device 303, e.g. as separate process chambers 305, 307, 309, 311 with work stations. For this purpose, appropriate handling devices 313, 315, 317, 319 are required, which remove the substrates resp. the carriers loaded with substrates from the transporting device 303 and position them in the respective processing station within each separate process chamber. The transport means 303 is operated intermittently in this case, i.e. the transport of the substrates resp. of the carrier is not continuous.

The individual process chambers 305, 307, 309, 131 in this case can be very well separated from each other, but other significant drawbacks will remain, such as the size of the entire coating facility, and the fact that the transport device continues to form an inseparable unit. There are further disadvantages, such as the required overhead for handling devices, the increased installation size for deploying these handling devices and in particular the need to build a larger room 321 in the complete transport device with an extraordinary quality of space in terms of freedom from dust and air purity. The corresponding air treatment is very expensive, not just the investment for the purchase of the equipment, but also the increased operating costs, mainly for energy and with respect to filter technology.

There is therefore a need for a coating facility that overcomes the aforementioned disadvantages of the prior art. The present invention therefore has as its aim to provide a coating facility with which the above disadvantages are overcome.

This aim is achieved according to the invention by means of a modular coating facility according to claim 1. In contrast to the individual elongated processing chambers resp. the arraying of parallel processing chambers known from the prior art, the chamber according to the invention, depending on the number of process steps, is divided in individual, completely separate work modules. Each of these modules preferably includes in its upper part a fresh air supply and at the bottom an extraction device for air and gas, and also in its lower part a transport device. Each of these modules includes an entrance door as well as an exit door. The term "door" in the context of this description means any type of shutter or closing mechanism for an opening through which the substrates can be transported in or out of the respective module.

The individual modules are then arranged in relation to one another in such a manner that the exit door of one module has in each case a connection with the entrance door to the subsequent module. Connection here means that a carrier loaded with substrates can be conveyed from the exit door of one module to the entrance door of a subsequent module. Preferably, the exit door of a module is arranged in the immediate vicinity of the entrance door of the subsequent module resp. the exit door and entrance door form one unit with a common driving mechanism. Only the entrance door of the first module of the system and the exit door of the last module of the system are isolated, i.e. not associated with a door of another module. It is possible for the purpose of this invention to possibly omit entrance and/or exit doors in individual modules if the respective process step allows it and/or the airflow conditions are selected so that cross-contamination respectively contamination or carryover of contaminants between the individual modules can be avoided.

The modules are each individually controlled by a central control unit. Preferably, each module receives its own control components, to which all system components to be controlled are connected; the control components thus arranged in a de-centralized manner are then to be connected to the central controller via a simple cable or via wireless communication or may possibly be managed with a master-slave configuration.

This inventive design has the significant advantage that only those components belonging to each module are connected electrically to one another and thus significantly less cable material and installation costs are required; a further advantage is that the need to providing a central control cabinet is not necessary.

Due to the modular design of the coating facility with completely independent modules, the latter can be transported easily and with little effort in single modules to their destination. Also the erection, installation and commissioning will thus be considerably simplified. Advantages include among others the cost and time savings, but also the reliability of operation achieved within the shortest possible time at the customer's facility by having the coating system already assembled and tested at the premises of the equipment manufacturer.

The invention will now be described in detail by way of example with the aid of the figures.

FIG. 1 shows a coating facility with an in-line design according to the prior art;

FIG. 3 shows a coating facility in modular design with discontinuous operation.

Figure 2:
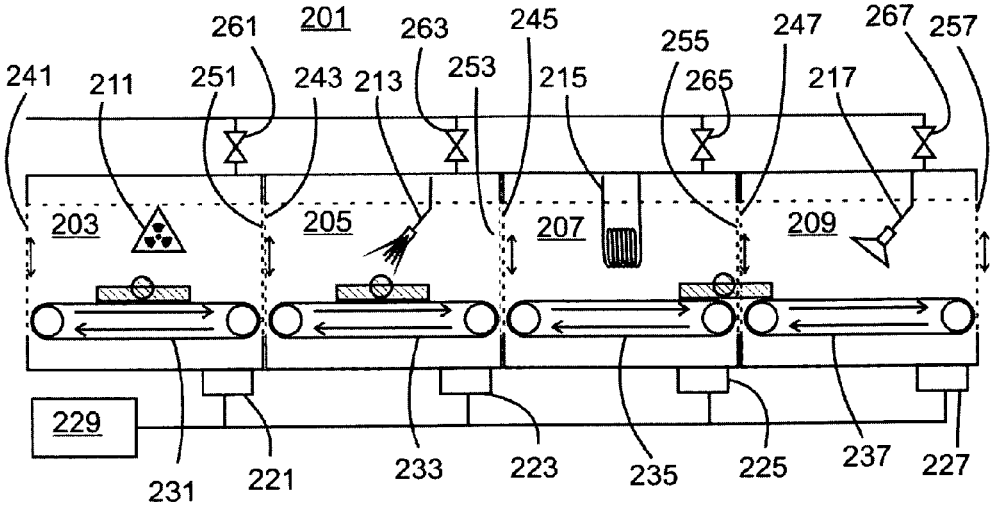
FIG. 2 shows an inventive coating facility in modular design.

The coating facility according to the prior art (FIGS. 1 and 2) has already been discussed above. FIG. 2 shows a coating facility 201 in a modular design according to the invention. It shows the modules of the entrance cleaning 203, inter alia by means of ionizing radiation 211, for the coating 205 by means of a spray nozzle on a robot arm 213, for the removal of the solvent (baking) 207 through heating by means of IR emitter 215 and for the curing of the coating material (hardening) 209 by UV light from a lamp 217. Each of these modules comprising its own control 221, 223, 225, 227, respectively, which are in turn controlled by a central controller 229. The module controls make it possible to control the transport devices 231, 233, 235 and 237 as well as the entrance doors 241, 243, 245, 247 and the exit doors 251, 253, 255, 257. In case the processing steps of two adjacent modules do not affect each other negatively, it is possible to omit the corresponding doors. In the case where a module follows the other module, it is also not absolutely necessary for both the exit doors of one module as well as the entrance doors of the other module to be implemented. In addition, the module controls also control the functional units such as spray nozzle and robotic arm 213, IR emitter 215, UV lamp 217 and venting installations 261, 263, 265 and 267 provided on each module. Therefore, each module is an essentially self-sufficient functional module whose interaction is controlled by the central control 229. The substrates to be coated are not reference in FIG. 1 with reference numbers but have been represented by surface crosshatching. On the substrate, which has been drawn between module 207 and module 209, it can be seen how the transport from one module to the other is achieved: thanks to the driving mechanism of the transport means 235, the substrate slides out of the module 207 and is displaced on the transport means 237 of the module 209. This naturally takes place with the doors 255 to 247 open.

For the insertion into the first module, a transport device as shown can also be used. The same applies for the ejection out of the coating installation. Specifically, the whole system including insertion and ejection apparatus can be designed as a cycle process so that the fitting of the substrates to be coated and the removal of the coated substrates can take place in one location, possibly by means of a robot and/or automatic device. This pure transport section need not be implemented in a clean room environment.

Due to the modular design of the coating facility, it is very simple to set it up and dismantle it. If a module of the coating system is defective, it can be easily replaced by another structurally equivalent one, without the whole coating installation having to be dismantled. Moreover, it is possible to complete the coating facility in an easy manner by adding further modules and thus further processing steps such as for example PVD coating. On the other hand, should the corresponding process step not be required by the customer, modules can be omitted. The manufacturer of the coating facility thus has the option of designing, on the basis of standardized modules, customized overall concepts for a coating facility.

What is claimed is:

1. Coating facility comprising at least the following means:

a) means for cleaning substrates to be coated;

b) means for coating the substrate; and c) means for curing the coated substrates;

wherein the coating facility is designed in a modular construction and a module is provided for each one of the means a) to c), respectively, wherein each module comprises its own transport device in such a manner that when the modules work together, a continuous inline transport through the modules in the direction of movement can be achieved, wherein each of the modules includes a housing having an entrance door and an exit door, wherein the individual modules are arranged in relation to one another in such a manner that the exit door of one module has in each case a connection with the entrance door of a subsequent module, wherein only the entrance door of a first module of the facility and the exit door of a last module of the facility are not connected to a door of another module, wherein the transport devices of the modules are arranged such that the substrates are transferred from the transport device of the one module onto the transport device of the subsequent module and wherein due to a driving mechanism of the transport devices each substrate slides out of the one module and is displaced on the transport device of the subsequent module, wherein an automatic device is provided for loading and unloading the coating facility, a first transport device is provided for conveying the substrates from the automatic device to the entrance door of the first module and a second transport device is provided for conveying the substrates from the exit door of the last module to the automatic device, and wherein the exit door of at least one module and the entrance door of a subsequent module form one unit with a common driving mechanism and wherein one of the modules is a module for physical vapor deposition coating.

2. Coating facility according to claim 1, characterized in that the entrance door and the exit door are provided for at least one of the modules to enable a tight seal of the module inner space against a surrounding environment.

3. Coating facility according to claim 1, characterized in that in the facility, it is provided for the curing of the coated substrates in at least two steps namely i) the removal of a solvent from the coating and ii) the curing of the coating, and in that the coating facility comprises for step i) a module with means for the execution thereof, and in that the coating facility comprises for step ii) a module with means for the execution thereof.

4. Coating facility according to claim 3, wherein the means for the execution for step i) comprises ventilation.

5. Coating facility according to claim 3, wherein the means for the execution for step i) comprises heating means.

6. Coating facility according to claim 5, wherein the heating means comprise one of a glow filament, a hot air and an infrared lamp.

7. Coating facility according to claim 3, wherein the means for the execution for step ii) comprises at least one irradiation source.

8. Coating facility according to claim 3, wherein the means for the execution for step ii) comprises a UV lamp.

9. Coating facility according to claim 1, characterized in that each module includes a control unit and associated electrics for controlling a venting installation, a processing means and the transport devices of the modules and a central controller is provided for coordinating the controls of each module.

10. Coating facility according to claim 1, characterized in that the transport devices are designed as conveyor belts and the transfer of the substrates is achieved by pushing the substrates out over the edge of one transport device to a subsequent transport device.

11. Coating facility according to claim 1, wherein the entrance door and the exit door comprise a shutter through which the substrates are transported in or out of the respective each module.

12. Coating facility according to claim 1, wherein each module is an essentially self-sufficient functional module whose interaction is controlled by a central control.

13. Coating facility according to claim 1, wherein the exit door of the one module is arranged in immediate vicinity of the entrance door of the subsequent module.

* * * * *